US007185392B2

(12) United States Patent
Murray

(10) Patent No.: US 7,185,392 B2
(45) Date of Patent: Mar. 6, 2007

(54) CORD-BASED ACCESSORY CADDY AND HAND-HELD STEAM VACUUM

(75) Inventor: Christopher J. Murray, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 487 days.

(21) Appl. No.: 10/273,322

(22) Filed: Oct. 17, 2002

(65) Prior Publication Data

US 2004/0074040 A1 Apr. 22, 2004

(51) Int. Cl.
*A47L 9/00* (2006.01)

(52) U.S. Cl. ..... 15/323; 15/344

(58) Field of Classification Search ..... 15/323, 15/344, 320; D32/31; 24/16 R, 16 PB; 211/52, 53, 316; 248/51, 52
See application file for complete search history.

(56) References Cited

U.S. PATENT DOCUMENTS 313,410 A * 3/1885 Eckert et al. ..... 24/16 PB
548,297 A * 10/1895 Crockett ..... 24/16 R
3,872,538 A 3/1975 Crouser ..... 15/323
4,106,165 A 8/1978 Clowers et al. ..... 15/323
5,071,296 A * 12/1991 Dietzen et al. ..... 279/149
D391,703 S 3/1998 Miller et al. ..... D32/31
5,732,438 A 3/1998 Tuvin et al. ..... 15/323
D414,337 S * 9/1999 Hubert ..... D3/315
D444,603 S 7/2001 Murphy et al. ..... D32/31
6,345,407 B1 2/2002 Jupp ..... 15/323
6,536,590 B1 * 3/2003 Godshaw et al. ..... 206/373

* cited by examiner

*Primary Examiner*—Theresa T. Snider
(74) *Attorney, Agent, or Firm*—Harness, Dickey & Pierce, P.L.C.

(57) ABSTRACT

A cord attachment mechanism is associated with a main body and adapted to attach the accessory caddy to the power cord. An accessory retention mechanism is associated with the main body and adapted to releasably retain a vacuum accessory on the accessory caddy. The main body is adapted to enable the accessory caddy to be manually repositioned along the cord; for example, by sliding or by removal and reattachment. A single, integral part having two sides separated by a living hinge is used to form the main body. Each side has a cooperating snap-fit member which is adapted to retain the two sides together. A hand-held steam vacuum cleaner is also provided which includes the accessory caddy on its power supply cord.

19 Claims, 4 Drawing Sheets

CORD-BASED ACCESSORY CADDY AND HAND-HELD STEAM VACUUM

FIELD OF THE INVENTION

The present invention relates to vacuum cleaning devices, and more particularly, to an accessory caddy for such vacuum devices.

BACKGROUND OF THE INVENTION

Vacuum cleaning devices commonly include accessories to enhance the vacuum cleaning function for different circumstances. These accessories have included variously shaped nozzles which can be attached to the vacuum inlet. Nozzle inlet accessories have also included different brush devices. Accessory caddy devices have been developed to store the accessories with the vacuum cleaner, so they do not become lost and are readily available for use during vacuum cleaning.

One type of accessory caddy has operated to store the accessories on the vacuum cleaner housing. Such housing-based accessory caddies have been used with canister, upright and hand-held vacuum cleaners. In each case, the additional weight of these accessory devices must be moved as the vacuum cleaner housing is moved. This additional weight is particularly problematic with hand-held vacuums where the user is manually supporting the housing.

Another type of accessory caddy has operated to store the accessories on the suction hose of the vacuum. Such suction hose-based accessory caddies store the accessories extremely close to their point of use Unfortunately, similar to the housing-based caddies, this type of accessory caddie typically requires that the additional weight of the accessories be carried by the user during vacuuming. In addition, the accessories are stored where they are most likely to hit an adjacent object and/or get knocked from the accessory caddy.

Upon careful study, Applicant has discerned these problems and developed an accessory caddy as disclosed herein. Applicant has discovered that it is desirable to have an accessory caddy which enables balancing of the desire to make the accessories readily available to a user during vacuuming with the desire to reduce, e.g., one or more of the problems discussed above.

SUMMARY OF THE INVENTION

In accordance with one aspect of the present invention, an accessory caddy for a vacuum cleaner having a power cord is provided. The accessory caddy has a main body and a cord attachment mechanism associated with the main body and adapted to attach the accessory caddy to the power cord. An accessory retention mechanism associated with the main body is adapted to releasably retain a vacuum accessory on the accessory caddy.

In accordance with another aspect of the present invention a cord attachment mechanism is associated with the main body and is adapted to enable the accessory caddy to be manually repositioned along the cord. The repositioning along the cord is preferably provided by permitting the accessory caddy to slide along the cord or by permitting the accessory caddy to be selectively removed and reattached to the power cord.

In accordance with yet another aspect of the present invention a hand-held steam vacuum cleaner including a vacuum accessory is provided. A housing is included with a debris collection bowl, a liquid supply tank, a steam outlet opening, and a vacuum inlet all associated with the housing. A power supply cord extends from the housing. An accessory caddy is adapted to be attached to the power supply cord and to releasably retain the vacuum accessory. The accessory caddy includes a single, integral part having two sides separated by a living hinge. Each side has a cooperating snap-fit member which is adapted to retain the two sides together.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. For example, although the invention is particularly beneficially used with a hand-held steam vacuum cleaner as described herein, the invention is generally not intended to be so limited.

Figure 1:
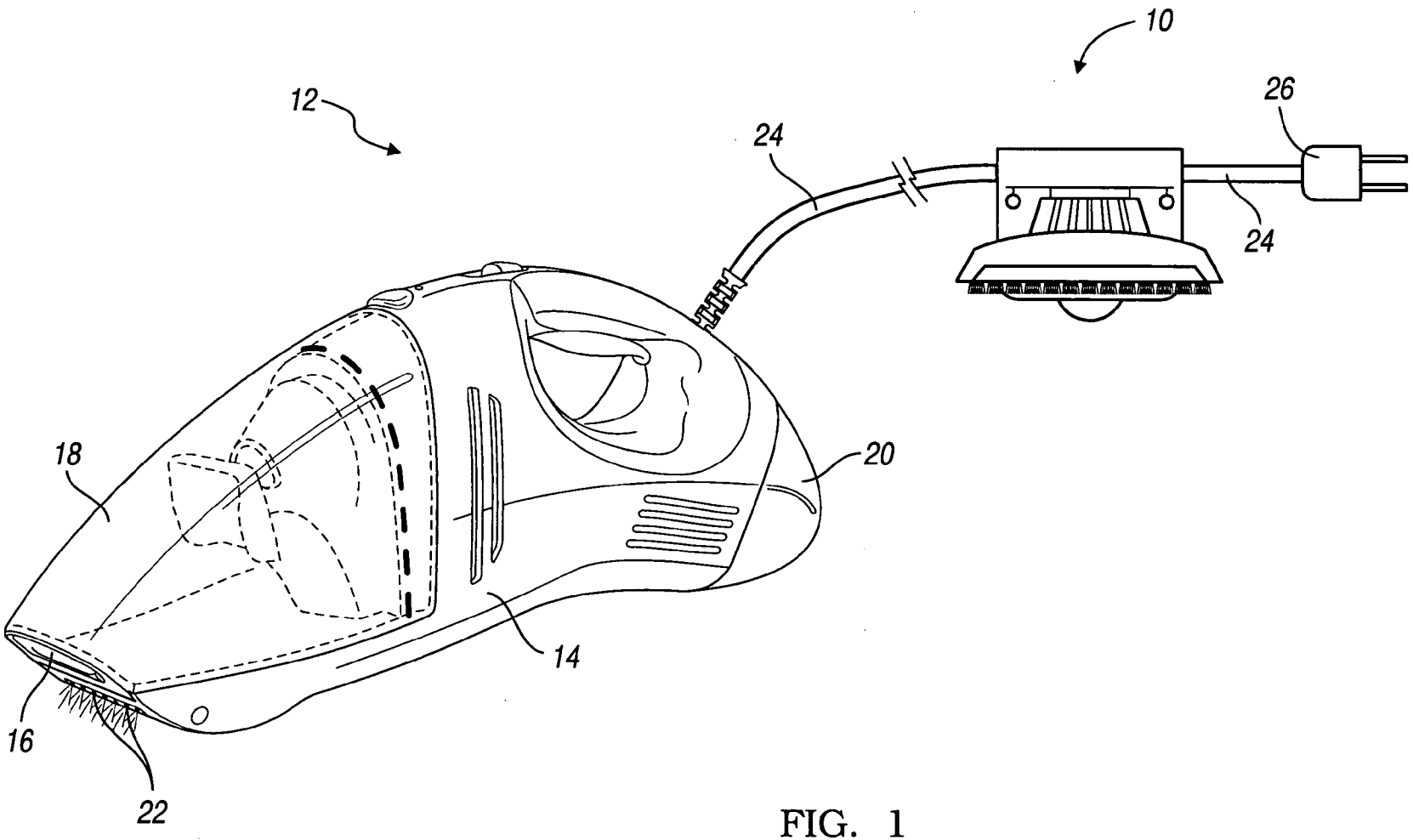
FIG. 1 is a perspective view of a corded hand held-steam cleaner incorporating a preferred embodiment of an accessory caddy of the present invention.

Referring to FIG. 1, a preferred cord-based accessory caddy of the present invention, indicated generally as 10, is illustrated in connection with a hand-held steam vacuum cleaner, indicated generally as 12. The hand-held steam vacuum cleaner 12 generally includes a main housing 14. This main housing 14 incorporates a vacuum inlet 16, a debris collection bowl 18 and a liquid supply tank 20. Liquid from the supply tank 20 is heated within the housing 14 and ejected through steam outlet openings 22 near the vacuum inlet 16. Electrical power is supplied to the vacuum cleaner 12 through an electrical power supply cord 24 extending from the housing. A plug 26 is provided at the distal end of the cord 24.

Figure 2:
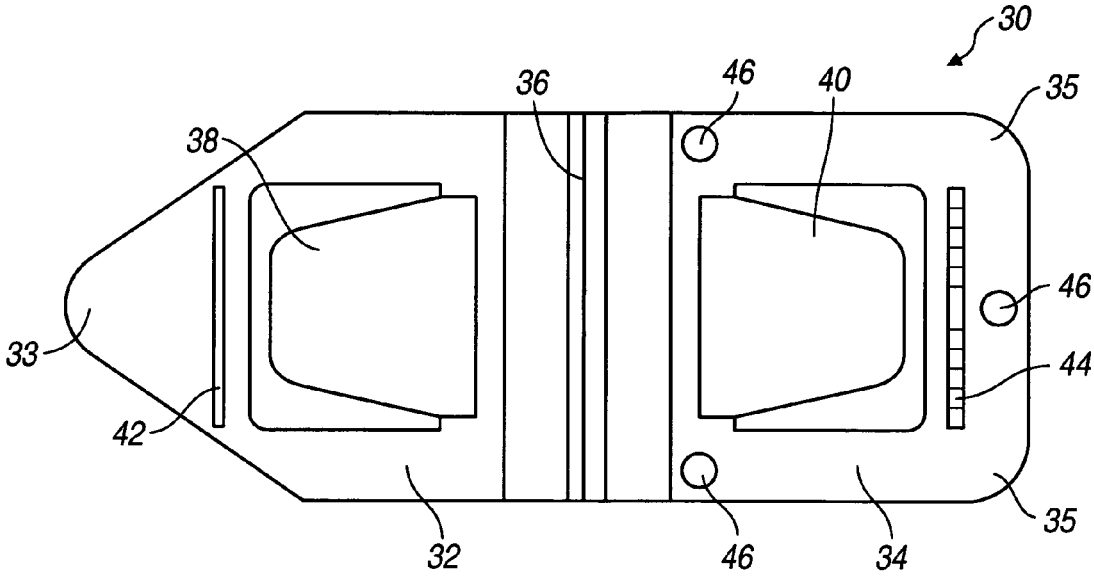
FIG. 2 is a top plan view of a blank from which the preferred accessory caddy of FIG. 1 is formed.
Figure 3:
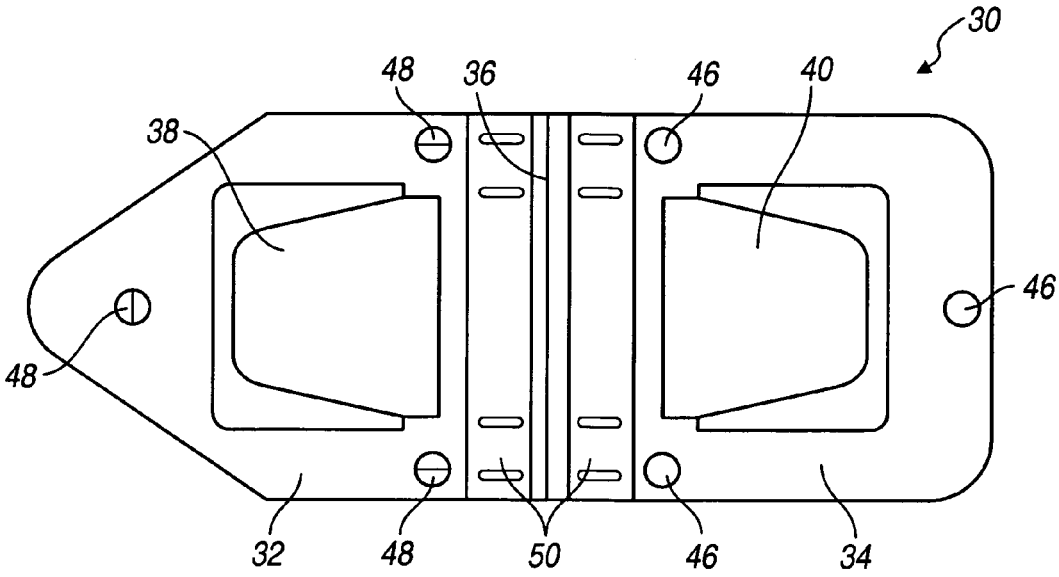
FIG. 3 is a bottom plan view of the blank of FIG. 2.

Referring to FIGS. 2 and 3, the accessory caddy 10 is formed from the illustrated thermoplastic molded blank 30 which when assembled forms the main body of the caddy 10. The blank 30 generally includes two sides 32, 34 integrally molded as a single part. The two sides 32, 34 of this single, integral part are separated from each other by a living hinge 36. Each side 32, 34 includes a resilient arm member 38, 40 and a protruding retention rib member 42, 44 extending from an outer surface of the generally planar side member 32, 34. Each side 32, 34 also includes a recessed groove 50 with raised elongated members 52 to accommodate the cord 24 as discussed hereinafter. The generally planar right side member 34 includes three retention apertures 46. The generally planar left side member 32 includes three locking protrusions 48 which cooperate with the retention apertures 46 to snap-fit the two sides 32, 34 together around the power supply cord 24 with the inner surfaces of the generally planar side members 32, 34 in face-to-face relation. Thus, each side 32, 34 has a cooperating snap-fit member 48 and 46, respectively, which is adapted to retain the two sides 32, 34 together. Thus, the grooves 50, in combination with the cooperating snap-fit members 46, 48, operate as a cord attachment mechanism.

Figure 4:
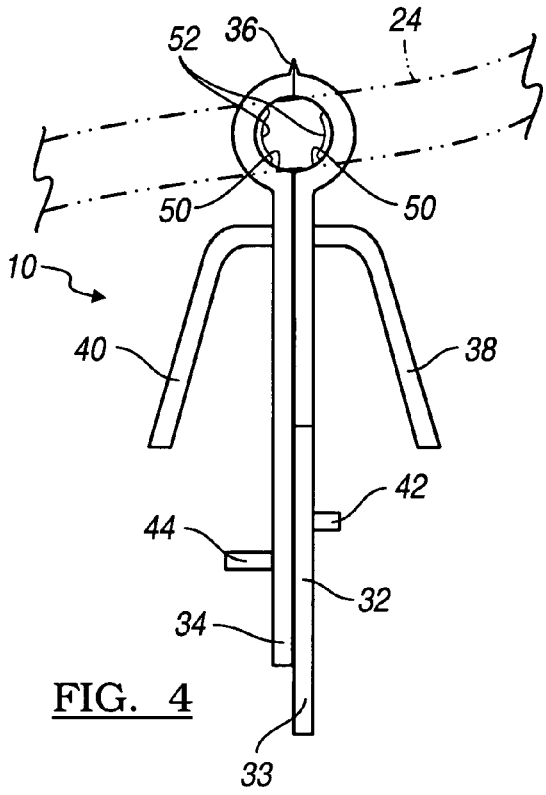
FIG. 4 is an enlarged side view of the accessory caddy formed from the blank of FIGS. 1 and 2.

Referring to FIG. 4, the main body of the accessory caddy 10 is illustrated in its assembled configuration. In this configuration, the power supply cord 24 is accommodated by the two semicircular grooves 50 which combine to grasp the cord 24 when the two sides 32, 34 are snap-fit together. The accessory caddy 10 preferably frictionally engages the cord 24 to resist its free movement along the cord 24. The raised elongated members 52 of the semicircular grooves 50 help resist the free movement of the caddy 10 along the cord 24. Thus, the accessory caddy 10 is preferably not free to move along the cord 24 under the weight of the caddy 10 and its supporting accessories. This resistance to free movement, however, is not so significant as to prevent manual displacement of the accessory caddy 10 by manually sliding it along the cord 24. In this way, the caddy 10 can be manually located in any position along the cord 24 and will stay there until manually moved (or otherwise acted upon by an external force).

Thus, the accessory caddy 10 is capable of being located adjacent the plug 26. This is accomplished, for example, by allowing for subsequent manual movement of the accessory caddy 10 to this location as indicated above. Alternatively, the accessory caddy 10 is permanently fixed to the cord 24 in a location adjacent the plug 26 at the factory. Preferably, the accessory caddy 10 is located adjacent the plug 26 within about the 75 percent of the cord length nearest the plug 26; more preferably, within about the 50 percent of the cord length nearest the plug 26; and even more preferably, within the about 25 percent of the cord length nearest the plug 26.

Being able to locate the accessory caddy 10 on the cord 24 adjacent the plug 26 offers several advantages. Adjacent the plug 26, the accessory caddy 10 is still attached to the hand-held steam vacuum 12 which reduces the possibility of the accessories 54, 56 (seen in FIG. 5) being misplaced. The accessories 54, 56 are also maintained within a reasonably close area to the vacuum inlet 16 where any vacuuming activities are taking place. Moreover, adjacent the plug 26, the vacuum accessories 54, 56 are not as likely to contact other objects in a way that would cause them to become dislodged from the caddy 10 due to the vacuuming motion. In addition, the weight and bulk of the vacuum accessories 54, 56 does not have to be managed by the user during vacuuming. Another potential advantage of locating the accessory caddy 10 near the plug 26 of the cord 24, is it reduces any caddy 10 interferance with the cord 24 being wrapped around the vacuum cleaner housing 14 for storage.

There are likewise several advantages to adapting the accessory caddy 10 so it can be manually repositioned along the cord 24 length. For example, it permits the user to choose how to balance the desire to have the accessories 54, 56 close at hand with weight and bulk disadvantages. Furthermore, it allows the user to make this choice each time the hand-held steam vacuum cleaner 12 is used. For example, when a particular steam vacuum cleaner 12 use requires the use of various accessories 54, 56, the overriding desire to have the accessories 54, 56 close would tend to result in the user placing the accessory caddy 10 closer to the vacuum housing 14. In contrast, a different steam vacuum cleaner 12 use which does not require any of the accessories 54, 56 would tend to result in the user sliding the accessory caddy 10 to a location closer to the plug 26.

With this preferred embodiment, the accessory caddy 10 is also adapted to be releasably attached to the power supply cord 24. Thus, the caddy 10 can be selectively completely removed from the cord 24 by the user as desired. Making the accessory caddy 10 releasable with respect to the cord 24 offers another way to relocate the accessory caddy 10 in different positions along the cord 24. Furthermore, this permits the accessory caddy 10 to be selectively completely removed from the vacuum 12 during a particular use. This is beneficial during a use, for example, where having the accessories 54, 56 close at hand is desirable, but the where the weight and/or bulk of the caddy 10 and its accessories 54, 56 is particularly problematic.

Returning to FIGS. 2 and 3, the accessory caddy 10 is releasable due to its reliance on the cooperating snap-fit members 46, 48. The releasable nature is further enhanced by the geometry of the generally planar side members 32, 34 of the main body of the caddy 10. The left side member 32 has a generally triangular shaped distal end 33 and the overall length of this left side member 32 (from the living hinge 36 to the distal end 33) is greater than the overall length of the right side member 34. Thus, the distal end 33 forms a peripheral tab portion of side member 32 that extends past side member 34. This peripheral portion may be pressed upon by a thumb or finger. Similarly, due to the generally triangular shape of the distal end of side member 32, the corners 35 form peripheral tab portion that extend laterally past side member 32. Thus, the corners 35 provide peripheral portion that may be pressed in the opposite direction by a cooperating thumb or finger to separate the cooperating snap fit members 46, 48, so the caddy 10 may be easily removed form the cord 24 and repositioned as desired.

Returning to FIG. 4, this preferred accessory caddy 10 is adapted to releasably retain two accessories; a brush accessory 54 and a squeegee accessory 56. Each accessory 54, 56 includes a vacuum passage therethrough (not shown) and is adapted to be attached to the vacuum inlet 16 of the housing 14. The brush accessory 54 includes a row of bristles 58 adjacent the vacuum passage inlet 60 and the squeegee accessory 56 includes resilient flexible edges 62 adjacent the vacuum passage inlet 60. Each resilient arm 38, 40 of the main body of the caddy 10 is adapted to extend into the vacuum passage of the corresponding accessory 56 and 54, respectively. As each accessory 56, 54 is pushed onto the corresponding resilient arm 38 and 40, respectively, the accessory 56 and 54 comes into contact with the corresponding protruding retention rib member 42 and 44, respectively. This causes the resilient arm 38, 40 to flex outwardly.

Figure 5:
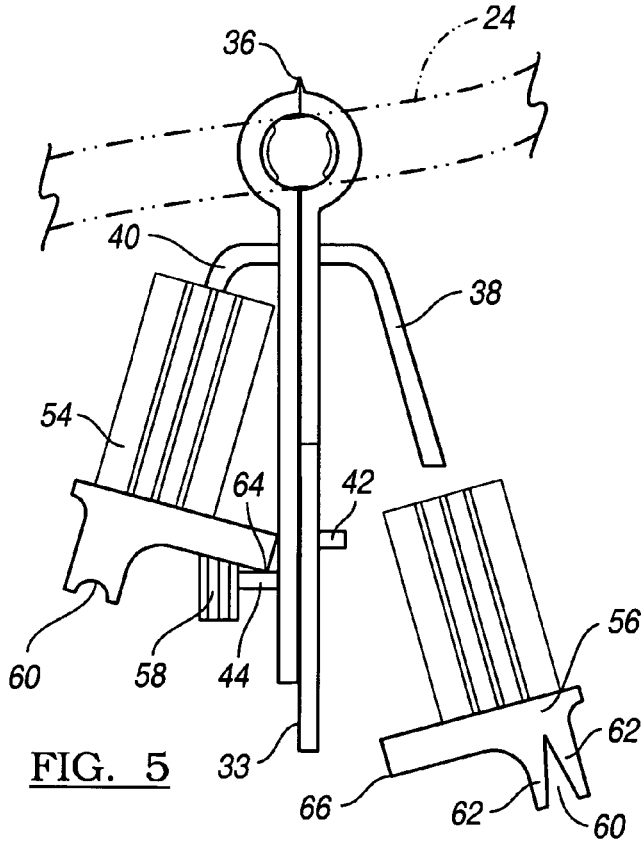
FIG. 5 is a side view similar to FIG. 4, but also illustrating the accessories.

As seen in FIG. 5, pushing the brush accessory 54 further onto the resilient arm 40, causes an edge 64 of the accessory 54 to pass the retention rib member 44 allowing the resilient arm 40 to return toward its original position. As a result, the protruding retention rib member 44 retains the accessory 54 on the caddy 10 by acting against an edge 64 of the accessory 54. In order to remove the accessory 54, the resilient arm 40 is again moved outwardly, allowing the edge 64 to pass the protruding retention rib 44 and permitting the accessory 54 to be removed from the caddy 10. The same process and structure is used with respect to the squeegee accessory 56. Thus, in each case an accessory retention mechanism is provided by each resilient arm 38, 40 and its cooperating protruding retention member 42 and 44, respectively.

Figure 6:
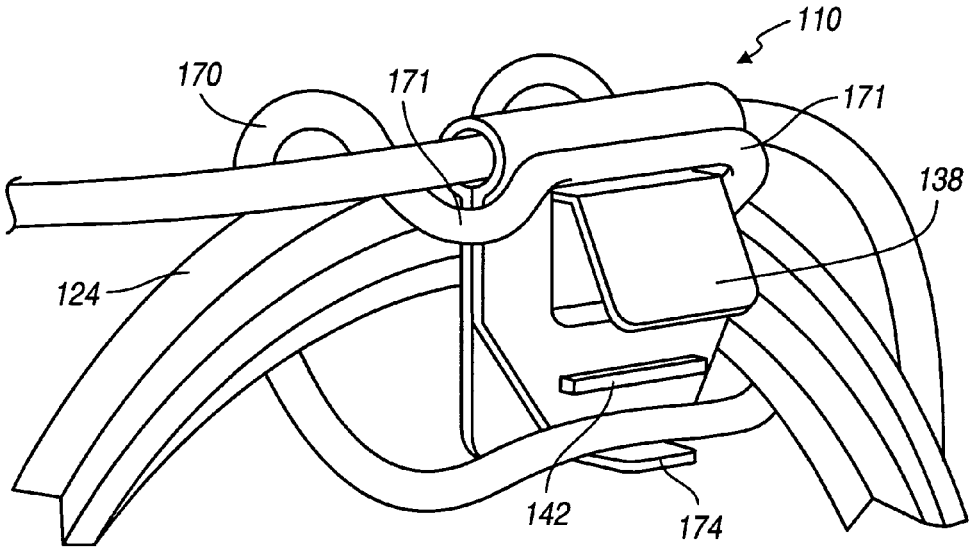
FIG. 6 is a perspective view of an alternative preferred embodiment of an accessory of the present invention.
Figure 7:
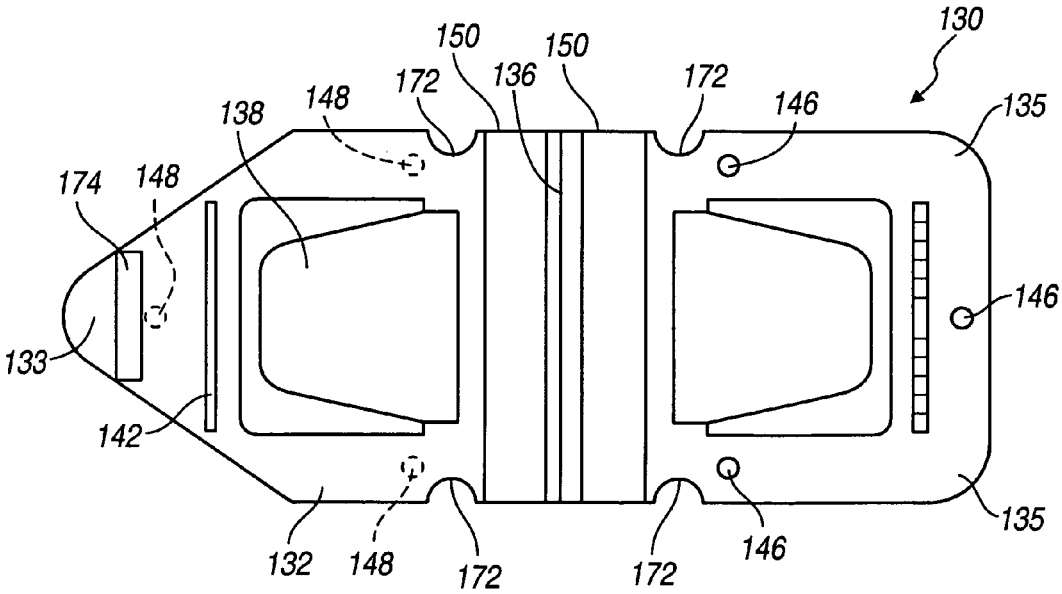
FIG. 7 is a top plan view of a blank from which the alternative preferred embodiment of FIG. 6 is formed.

Referring to FIG. 6 and FIG. 7, an alternative preferred accessory caddy 110 according to the present invention and the blank 130 from which it is formed is illustrated. Although in a storage configuration as illustrated the accessories would be mounted on the caddy, they have been removed in the illustration of FIG. 6 to aid clarity. This alternative preferred embodiment is similar to the previously described embodiment. Thus, many of the features of this embodiment are identical or nearly identical to those previously discussed. As such, they are not discussed again here. These features are simply referenced by numerals which are only different in that they include a 100's digit. The notably different features with respect to this alternative preferred embodiment are discussed below.

This alternative preferred accessory caddy 110 includes a loop of elastic material 170 extending from it. The loop of elastic material 170 is attached to the main body of the accessory caddy 110 at two points 171 along the loop. Each of these attachment points 171 of the elastic loop 170 is forced into a slot 172 at the edge or sides of the main body of the caddy 110. The slots 172 have a dimension which is smaller in size than a corresponding dimension of the elastic loop material 170. Thus, upon inserting the elastic material 170 into the slot 172, the elastic loop 170 is retained by the slots 172; thereby attaching the loop of elastic material 170 to the main body of the caddy 110.

A elastic catch member 174 is located at the distal end of generally planar side member 132. When the power supply cord 124 is wound up, the elastic material 170 loops around the wound-up cord 124 and is hooked onto the elastic catch member 174. Thus, the accessory caddy 110 is adapted to retain the wound-up cord 124 in its wound-up state for storage and the elastic member 170 and elastic catch member 174 operate as a cord storage mechanism.

Of course, many modifications may be made to produce additional alternative embodiments beyond those described above. For example, in one such alternative embodiment the elastic loop material is replaced by a cord clip as has been used to maintain a cord in a wound-up condition. Another exemplary alternative embodiment releasably retains more than two accessories thereon. A further exemplary alternative embodiment uses a different structure as the accessory retention mechanism.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vacuum cleaner comprising:

a vacuum cleaner main housing including a vacuum source;

a power supply cord extending from the vacuum cleaner main housing and having a plug at the distal end thereof;

an accessory caddy main body;

a cord attachment mechanism connected to the accessory caddy main body, the cord attachment mechanism having a configuration which permits attachment of the accessory caddy main body to the power supply cord when the power supply cord is attached to the plug at the distal end and to the vacuum cleaner main housing at the other end; and a plurality of separate accessory retention mechanisms connected to the accessory caddy main body, each of the plurality of separate accessory retention mechanisms releasably retaining a different one of a plurality of vacuum accessories on the accessory caddy.

2. The vacuum cleaner according to claim 1, wherein the accessory caddy main body is located adjacent a plug of the power supply cord.

3. The vacuum cleaner according to claim 1, wherein the cord attachment mechanism further comprises cooperating components to enable the selective removal and reattachment of the accessory caddy to the power supply cord.

4. The vacuum cleaner according to claim 1, wherein the cord attachment mechanism cooperates with the power cord to support the weight of the accessory caddy and any associated vacuum accessories to retain the accessory caddy in a fixed position along the power supply cord.

5. The vacuum cleaner according to claim 1, wherein the accessory retention mechanism further comprises a resilient arm positioned to cooperate with a protruding retention member to releasably retain the vacuum accessory.

6. The vacuum cleaner according to claim 1, wherein the cord attachment mechanism comprises a passage through which the power supply cord extends.

7. An accessory caddy for a vacuum cleaner having a power supply cord, comprising:

a main body;

a cord attachment mechanism connected to the main body and adapted to attach the main body to the power supply cord; and an accessory retention mechanism connected to the main body and comprising a resilient arm adapted to cooperate with a protruding retention member, wherein the protruding retention member is an elongated rib which engages against an edge of the vacuum accessory to releasably retain the vacuum accessory on the accessory caddy.

8. A vacuum cleaner comprising:

a vacuum cleaner main housing including a vacuum source;

a vacuum-cleaner-power-supply cord extending from the vacuum cleaner main housing;

an accessory caddy main body;

a vacuum-cleaner-power-supply-cord attachment mechanism connected to the accessory caddy main body;

a releasable vacuum-cleaner-accessory retention mechanism connected to the accessory caddy main body; and a vacuum-cleaner-power-supply-cord storage mechanism connected to the accessory caddy main body;

wherein the accessory caddy is attached to the vacuum-cleaner-power-supply cord by the vacuum-cleaner-power-supply-cord attachment mechanism.

9. An accessory caddy for a vacuum cleaner having a power cord, comprising:

a main body;

a vacuum-cleaner-power-cord attachment mechanism including cooperating snap-fit components connected to the main body, the cooperating snap-fit components being engageable together to attach the main body to the power cord; and a releasable vacuum-cleaner-accessory retention mechanism connected to the main body and having a resilient arm which extends into a space of a vacuum cleaner accessory during retention, the resilient arm having a position in which a vacuum cleaner accessory will be retained, and being movable to another position in which a vacuum cleaner accessory will be released.

10. The accessory caddy according to claim 9, wherein the vacuum-cleaner-power-cord attachment mechanism comprises a recess that is sized to enable the accessory caddy to be manually repositioned along the power cord by permitting the accessory caddy to slide along the power cord, and is sized to resist movement of the accessory caddy along the power cord.

11. The accessory caddy according to claim 9, wherein the cooperating snap-fit components of the vacuum-cleaner-power-cord attachment mechanism are selectively releasable to enable the accessory caddy to be manually repositioned along the power cord, thereby permitting the accessory caddy to be selectively removed and reattached to the power cord.

12. The accessory caddy according to claim 9, wherein the releasable vacuum-cleaner-accessory retention mechanism further comprises a protruding retention member positioned in relation to the resilient arm to cooperate with the resilient arm to releasably retain a vacuum cleaner accessory.

13. The accessory caddy according to claim 9, wherein the vacuum-cleaner-power-cord attachment mechanism comprises a passage through which the power cord extends.

14. A hand-held steam vacuum cleaner including a vacuum accessory, comprising:

a housing having a debris collection bowl, a liquid supply tank, a steam outlet opening, and a vacuum inlet all associated with the housing;

a power supply cord extending from the housing;

an accessory caddy adapted to be attached to the power supply cord and to releasably retain the vacuum accessory, the accessory caddy comprising a single, integral part having two sides separated by a living hinge, each side having a cooperating snap-fit member which is adapted to retain the two sides together.

15. The hand-held steam vacuum cleaner according to claim 14, wherein at least one of the sides of the accessory caddy has a resilient arm adapted to cooperate with a protruding retention member to releasably retain the vacuum accessory.

16. The hand-held steam vacuum cleaner according to claim 15, wherein the protruding retention member is an elongated rib which engages against an edge of the vacuum accessory to retain the vacuum accessory on the accessory caddy.

17. The hand-held steam vacuum cleaner according to claim 14, wherein each side of the accessory caddy includes an extending peripheral portion adapted to enable a thumb and a finger of a user to be used to disengage the cooperating snap-fit members.

18. The hand-held steam vacuum cleaner according to claim 14, wherein at least one of the sides of the accessory caddy has a groove through which the power supply cord passes when the sides are snap-fit together.

19. The hand-held steam vacuum cleaner according to claim 14, wherein the accessory caddy further comprises an elastic member adapted to retain the power supply cord in a storage configuration.

* * * * *